United States Patent [19]

Burns, Jr.

[11] Patent Number: 4,857,232

[45] Date of Patent: Aug. 15, 1989

[54] CABLE CONDUCTOR SHIELD

[75] Inventor: Norman M. Burns, Jr., North Plainfield, N.J.

[73] Assignee: Union Carbide Corporation, Danbury, Conn.

[21] Appl. No.: 172,217

[22] Filed: Mar. 23, 1988

[51] Int. Cl.[4] ..... H01B 1/06

[52] U.S. Cl. ..... 252/511; 524/495; 524/496; 428/368; 428/372; 174/102 R; 174/102 SC; 174/102 SP

[58] Field of Search ..... 252/511; 524/495, 496; 174/102 SC, 102 SP, 102 R, 105 SC; 428/372, 379, 368

[56] References Cited

U.S. PATENT DOCUMENTS

| | | | |
|---|---|---|---|
| 4,246,142 | 1/1981 | Ongchin | 252/511 |
| 4,421,678 | 12/1983 | Mehta | 252/511 |
| 4,493,787 | 1/1985 | Taniguchi et al. | 174/102 SC |
| 4,696,765 | 9/1987 | Kakizaki et al. | 252/511 |

*Primary Examiner*—Josephine Barr
*Attorney, Agent, or Firm*—Saul R. Bresch

[57] ABSTRACT

A cable conductor shield composition comprising (i) ethylene-vinyl acetate copolymer wherein the vinyl acetate is present in an amount of about 8 to about 14 parts by weight and (ii) the following components in about the following parts by weight, all based on 100 parts by weight of copolymer:

| Components | Parts by Weight |
|---|---|
| polyethylene having a density of about 0.90 to about 0.95 | 29 to 36 |
| carbon black having a surface area of about 650 to about 1200 square meters per gram | 19 to 25 |
| an antioxidant | at least 0.1 |
| a processing aid | at least 0.1 |
| an organic peroxide curing agent | at least 0.5 |

2 Claims, No Drawings

CABLE CONDUCTOR SHIELD

This application is a continuation of prior U.S. application Ser. No. 20,440, filed Mar. 2, 1987, now abandoned.

This invention relates to compositions useful as cable conductor shields.

BACKGROUND ART

Cable conductor shields have been utilized in multilayered power cable construction for many years. These shields provide a layer of intermediate conductivity between the conductor and the cable insulation. Typical shield compositions contain ethylene vinyl acetate copolymer having a high vinyl acetate content, i.e., in the 18 to 20 percent by weight range, carbon black, a crosslinking agent, and other conventional additives. While these compositions have been found to be commercially acceptable, they are lacking in one respect, i.e., they are subject to marring when passed through conventional extrusion equipment used to apply the shield. A marred (or damaged) conductor shield can be expected to have a major negative impact on cable performance and expected life. The damage to the conductor shield can range from a minor flattening to breaks in the shield where portions are gouged out. These defects result in an imperfect interface with the cable insulation.

The damage may occur, for example, in a tandem extrusion line where the conductor shield comes in contact with the hot guider of the insulating extruder. Common causes of the problem are misalignment of the extrusion equipment where the cable enters the guider; sharp corners or scratches on the uider; and/or vibration in the line.

DISCLOSURE OF THE INVENTION

An object of this invention, therefore, is to provide a composition adapted for use as a cable conductor shield, which, as a finished product, has physical properties, e.g., tensile strength, tensile elongation, and low temperature brittleness, substantially equivalent to commercially available shields and, yet, is found to be essentially free of marring after processing in an extruder.

Other objects and advantages will become apparent hereinafter.

According to the present invention, such a composition, useful in a cable conductor shield, has been discovered. The composition comprises (i) ethylene vinyl acetate copolymer wherein the vinyl acetate is present in an amount of about 8 to about 14 parts by weight and (ii) the following components in about the following parts by weight, all based on 100 parts by weight of copolymer:

| Components | Parts by Weight |
|---|---|
| polyethylene having a density of about 0.90 to about 0.95 | 29 to 36 |
| carbon black having a surface area of about 650 to about 1200 square meters per gram | 19 to 25 |
| an antioxidant | at least 0.1 |
| a processing aid | at least 0.1 |
| an organic peroxide curing agent | at least 0.3 |

DETAILED DESCRIPTION

Copolymers of ethylene and vinyl acetate (EVA copolymers) are well known and can be prepared by conventional methods. The amount of vinyl acetate in the copolymer is about 8 to about 14 parts by weight based on 100 parts by weight of EVA copolymer. The preferred amount of vinyl acetate is about 9 to about 12 parts by weight.

The polyethylene can be either low pressure or high pressure polyethylene. The density of the polyethylene can be in the range of about 0.90 to about 0.95 and is preferably in the range of about 0.920 to about 0.935.

Polymer density is determined by following the procedure recited in ASTM D 1505. A plaque is made and conditioned for one hour at 100° C. to approach equilibrium density. Measurement for density is then made in a density gradient column and density values are reported in grams per cubic centimeter. The low density polyethylene can be made by the low pressure process described in European Patent Application 0 120 503, incorporated by reference herein, wherein ethylene is polymerized together with an alpha olefin comonomer having 3 to 8 carbon atoms, or by other conventional techniques. In the present application, low pressure, low density polyethylenes are considered to include copolymers of ethylene and an alpha olefin. High pressure, low density polyethylenes can be made by the process described in "Introduction to Polymer Chemistry", J. K. Stille, Wiley and Sons, 1962, pages 149 to 151, incorporated by reference herein. The polyethylene is present in the composition in the range of about 29 to about 36 parts by weight per 100 parts by weight of EVA copolymer, and preferably in the range of abbut 32 to about 34 parts by weight.

The carbon black has a surface area of about 650 to about 1200 square meters per gram and preferably about 750 to about 800 square meters per gram. It is present in the composition in an amount of about 19 to about 25 parts by weight per 100 parts by weight of EVA copolymer and preferably about 21 to about 24 parts by weight.

Polymerized 1,2-dihydro 2,2,4 trimethyl quinoline is an antioxidant suitable for subject composition. The antioxidant is present in the composition in an amount of at least about 0.1 parts by weight, usually about 0.1 to about 5 parts by weight, based on 100 parts by weight of EVA copolymer and is preferably present in an amount of about 0.9 to about 1.3 parts by weight.

While the particular amine mentioned above is preferred, any antioxidant conventionally used in cable conductor hields will suffice. Examples of antioxidants are sterically hindered phenols such as tetrakis [methylene(3,5 di-tertbutyl-4-hydroxyhydrocinnamate)]methane; thiodiethylene bis(3,5-di-tert-butyl-4-hydroxy) hydrocinnamate; 1,3,5-trimethyl 2,4,6-tris(3,5 di-tertiary butyl-4-hydroxybenzyl)benzene; 1,3,5-tris(3,5-di-tertiary butyl 4-hydroxy benzyl) 5-triazine 2,4,6-(lH,3H,5H)trione; tetrakis-[methylene 3 (3'5-di-t butyl 4'-hydroxy phenyl)-propionate]methane; di(2-methyl-4 hydroxy-5-t butyl phenyl)sulfide; 4,4'-thio bis-(3 methyl 6-tert butylphenol); phosphites and -phosphonites such as tris(2,4-di-tert butylphenyl)phosphite and di tert butylphenylphosphonite; and amines other than the guinoline mentioned above.

As for antioxidants, processing aids (or lubricants) conventionally used in cable conductor shields can be utilized in subject composition. They are useful in achieving a homogenous blend. Examples of processing aids are metal stearates such as stearates of zinc, aluminum, calcium, and magnesium and metallic salts of other fatty acids such as oleates and palmitates, and the fatty acids themselves, e.g., stearic acid. Polysiloxanes can be used instead of the fatty acid metal salts if desired, for example, polydimethylhydrosiloxane and polymethylsiloxane. Another suitable processing aid is polyethylene lycol having a molecular weight in the range of about 15,000 to about 25,000. Processing aids are included in an amount of at least about 0.1 parts by weight, usually about 0.1 to about 3 parts by weight, based on 100 parts by weight of EVA copolymer. The preferred amount of processing aids is about 0.15 to about 0.25 parts by weight.

Finally, a conventional organic peroxide is incorporated into subject composition as a free radical generator, i.e., a crosslinking or curing agent. The curing agent is incorporated into the composition in an amount of at least about 0.5 parts by weight, usually in the range of about 0.5 to about 5 parts by weight, based on 100 parts by ht of EVA copolymer. The preferred amount of crosslinking agent is in the range of about 2.7 to about 3.1 parts by weight. Examples of useful organic peroxides are dicumyl peroxide; di(tertiarybutyl) peroxide; 2,5-dimethyl-2,5-di(t butylperoxy)-hexane; alpha,alpha' bis(tertiary butylperoxy) diisopropylbezzene; and 2,5 dimethyl-2',5') di(tertiary butylperoxy) hexyne 3.

It should be noted that mixtures of antioxidants, processing aids, and organic peroxide curing agents can be used. Insulation shields, which have similar components, are desc in U.S. Pat. No. 4,150,193 issued Apr. 17, 1979, and is incorporated by reference herein.

The invention is illustrated by the following examples.

EXAMPLE 1

Two blends are tested, Blend I representing subject invention and Blend II representing a conventional conductor shield composition.

The composition of Blend I is as follows:

| | | Parts by Weight |
|---|---|---|
| (i) | EVA copolymer containing 11 parts by weight vinyl acetate | 100 |
| (ii) | polyethylene having a density of 0.924 | 33.4 |
| (iii) | carbon black having a surface area of about 750 square meters per gram | 22.6 |
| (iv) | Polymerized 1,2-dihydro-2, 2,4-trimethyl quinoline | 1.1 |
| (v) | zinc stearate | 0.2 |
| (vi) | dicumyl peroxide | 2.9 |
| | The composition of Blend II is as follows: | |
| (i) | EVA copolymer containing 18 parts by weight vinyl acetate | 100 |
| (ii) | carbon black having a surface area of about 250 square meters per gram | 58.4 |
| (iii) | Polymerized 1,2-dihydro-2, 2,4-trimethyl quinoline | 1.1 |
| (iv) | zinc stearate | 0.2 |
| (v) | dicumyl peroxide | 2.9 |

Note: in the examples, parts by weight of vinyl acetate are based on 100 parts by weight of EVA copolymer.

Each blend is blended as follows: All components are charged into a mixer such as a Banbury mixer. The mixture is fluxed at about 120° C. for about 3 minutes at about 60 rpm. The ram is raised to allow the batch to turn over after which the ram is lowered, and the fluxing is continued for about 2 minutes. The batch is dropped at about 120° C. to 130° C. and is either granulated by passing it through a two roll mill followed by a grinder or pelletized in an extruder in a conventional manner.

In order to test each blend, compression molded plaques are prepared according to ASTM D 1928, Procedure A, at 120° C. Test specimens cut from the plaques are then subjected to a "cut-through" test. In this test, a steel wedge is forced through a specimen with a tensile compression tester. The force (in pounds) required to cut through the specimen at various temperatures is recorded. The results are as follows:

| Temperature (°C.) | Pounds | |
|---|---|---|
| | Blend I | Blend II |
| 20 | 1550 | 950 |
| 40 | 1250 | 800 |
| 60 | 1150 | 450 |
| 80 | 1100 | 300 |
| 100 | 650 | 200 |

The physical properties of the two blends are are follows:

| | Blend I | Blend II |
|---|---|---|
| tensile strength (psi): ASTM 412 | 3000 | 2800 |
| tensile elongation (%): ASTM 412 | 400 | 200 |
| low temperature brittleness (°C.): ASTM-D-746 - the temperature at which 20% by weight of the specimen fails by shattering. | minus 60 | minus 55 |

EXAMPLE 2

In a tandem extrusion cable line, the insulating extrusion head is deliberately rotated causing a conductor shield having the Blend II composition (see Example 1) entering the guider to be pulled over a sharp, hot corner. The sharp edge cuts into the shield down to the conductor setting up a vibration and a series of cuts. A conductor shield having the Blend I composition (see Example 1) is put through the same test; this conductor shield resists the cutting effect and is smoothly pulled across the sharp edge without damage being caused to the conductor shield.

I claim:

1. An extruded crosslinked cable conductor shield consisting essentially of (i) 100 parts by weight of ethylene-vinyl acetate copolymer wherein the vinyl acetate is present in an amount of about 8 to about 14 parts by weight; (ii) polyethylene having a density of about 0.90 to about 0.95 gram per cubic centimeter in an amount of about 29 to about 36 parts by weight; and (iii) carbon black having a surface area of about 650 to about 1200 square meters per gram in an amount of about 19 to about 25 parts by weight 2. The cable conductor shield defined in claim 1 wherein:

(i) the vinyl acetate is present in the copolymer in an amount of the vinyl acetate is present in the copolymer in an amount of about 10 to about 12 parts by weight;

(ii) the polyethylene has a density of about 0.920 to about 0.935 gram per cubic centimeter and is present in an amount of about 32 to about 34 parts by weight; and (iii) the carbon black has a surface area of about 750 to about 850 square meters per gram in an amount of about 21 to about 24 parts by weight.

* * * * *